US005921189A

United States Patent [19]

Estepp

[11] Patent Number: 5,921,189

[45] Date of Patent: Jul. 13, 1999

[54] TUBULAR PALLET APPARATUS

[76] Inventor: Gary N. Estepp, 1130 Willow Trail, Bosque Farms, N.Mex. 87068

[21] Appl. No.: 09/048,436

[22] Filed: Mar. 26, 1998

Related U.S. Application Data

[60] Provisional application No. 60/041,702, Mar. 26, 1997.

[51] Int. Cl.[6] ..... B65D 19/38

[52] U.S. Cl. ..... 108/57.16; 108/57.22; 108/57.25; 108/901

[58] Field of Search ..... 108/57.16, 57.22, 108/57.25, 57.26, 57.31, 51.1, 57.1, 901, 57.21

[56] References Cited

U.S. PATENT DOCUMENTS

| | | | |
|---|---|---|---|
| 1,832,759 | 11/1931 | Bennett | 108/55.1 |
| 2,536,587 | 1/1951 | Whalley | 108/57.1 |
| 3,093,216 | 6/1963 | Dunham | 108/57.12 |
| 4,838,178 | 6/1989 | Chriske et al. | 108/57.13 |
| 5,456,189 | 10/1995 | Belle Isle | 108/57.17 |

*Primary Examiner*—Peter M. Cuomo
*Assistant Examiner*—Gerald A. Anderson
*Attorney, Agent, or Firm*—Rod D. Baker

[57] ABSTRACT

Two or more tube structures preferably are extruded or pultruded in plastic or resin to make a pallet that is strong and durable. The tubes preferably are extruded simultaneously to create a one piece, integrated pallet. The pallet may be molded from recycled plastic. Various configurations of pallets made from several tubes are disclosed, including custom pallets for receiving particular or specially shaped items.

2 Claims, 7 Drawing Sheets

TUBULAR PALLET APPARATUS

CROSS-REFERENCE TO RELATED APPLICATIONS

This application claims the benefit of priority filing of U.S. Provisional Application Ser. No. 60/041,702, entitled "Extruded Tubular Stacking and Storage Device," filed Mar. 26, 1997, the entire disclosure of which is hereby incorporated by reference.

BACKGROUND OF THE INVENTION

1. Field of the Invention (Technical Field)

The invention relates to pallets for shipping and moving items, specifically to a shipping pallet formed by continuous extrusion or pultrusion or molding.

2. Background Art

Pallets are used in shipping and storing to promote ready loading, unloading, and movement of items by mechanized equipment such as forklifts. A pallet provides a flat level surface upon which the shipped item, or stack of items, may be placed an/or secured. The pallet typically has a space or spaces into which the tines of a forklift may be inserted to lift and move the shipped item or items. Also, pallets serve the beneficial function of supporting the shipped item several inches off the floor, thus providing some measure of protection against wet and dusty floors and the like. Pallets traditionally have been manufactured at the least possible cost, with the result that most pallets are fashioned from very low-end lumber.

The use of low-quality lumber has allowed pallets to be manufactured in a variety of shapes and sizes, and also has permitted pallets to be treated as essentially disposable. Thus, pallets frequently are used one-way; sometimes recycled at the shipping destination, just as commonly they are landfilled or discarded after one or two uses.

More recently, plastic pallets have been introduced to the shipping industry, especially in circumstances where cleanliness is important. Traditional wooden pallets tend to attract and harbor a variety of insect and other pests. Moreover, most wooden pallets must have cross-boards fastened on the top and bottom thereof; the failure of board fasteners and the loss of cross-boards is the dominant failure mode for typical lumber pallets.

From the foregoing background, the present invention was developed.

SUMMARY OF THE INVENTION

The invention relates to shipping pallets. More specifically, there is provided a shipping pallet apparatus fashioned from plastic, such as recycled plastic. The various embodiments of the invention preferably are extruded or pultruded, but may be molded, to provide particularly useful shapes and configurations that also manifest tremendous strength, durability, and service life.

An object of the invention is to provide a shipping pallet that is reusable yet inexpensively manufactured.

An advantage of the invention is that there is provided a pallet that may be readily manufactured in nearly any width or length using the same manufacturing machine.

Another advantage of the invention is that there is provided a pallet with a tubular design which design improves structural strength and integrity while eliminating the need to fasten cross-boards to the top and bottom of the pallet.

Another advantage of the invention is that recycled plastics may be used to manufacture the invention.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings:

FIG. 1*a* is an enlarged view of the portion A of the embodiment shown in FIG. 1;

DESCRIPTION OF THE PREFERRED EMBODIMENTS

Best Mode for Carrying Out the Invention

Broadly described, the present invention is of a shipping pallet having two or more horizontal parallel square or rectangular tubes formed by the extrusion, pultrusion or molding of plastic, resin, or the like. The inventive pallet preferably is formed in an integrated one-piece construction with low production costs and improved strength characteristics. Alternatively, the invention may be assembled from two or more individual tubes adhered or joined together forming a single pallet, platform or shipping device. The invention has been fabricated using both commonly known and modified extruders, pultrusion devices and/or molded in poured, compression or injection molding systems.

Additionally, the invention may be fabricated from any material, such as plastics and resins, which can be extruded, molded or compressed into shapes. Depending on the system and material types, the invention can be fabricated at either ambient (e.g. from about 30° to about 150° F.) or elevated (e.g. from 100° to over 2000° F.) temperatures. The time required for fabrication is equipment and material dependant. For example, cold extrusion with particular recycled plastic processes or compression with thermoset resins can be completed in less than a minute for each full size pallet, while melt processes demand a cooling period, and a full-size pallet may take several minutes to solidify and retain shape. An advantage of the invention is that, in the preferred embodiment, all the major components of a pallet are integrated at the point and time of extrusion or molding, thereby providing a pallet that is virtually indestructible.

Due to the preferred one-piece design of the preferred embodiment, damage to cargo is eliminated by fastener snagging and puncturing. Also, the elimination of nails and other fasteners makes for a pallet that may easily be slid across the floor or other supporting surface without scratching or scarring. As the preferred embodiment is composed of extruded plastic, the reduced friction between pallet and floor allows easier sliding movement of the pallet across the floor or dock, which may permit dispensing with the slip sheets now occasionally encountered in the shipping industry.

Figure 1:
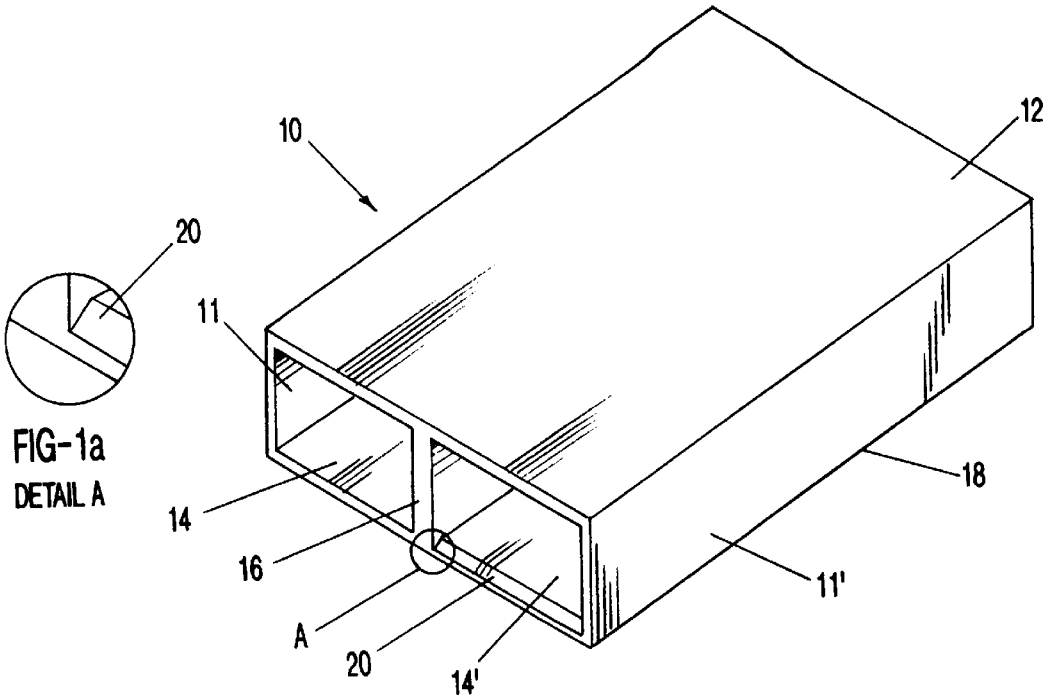
FIG. 1 is a perspective view of one preferred embodiment of the present invention, showing a two-tube, two-way pallet.

Attention is invited to FIG. 1, which shows a two-tube, two-way pallet 10 according to the invention. Pallet 10 has a top 12, a bottom 18, two side stringers 11, 11' extending between the top and the bottom, and two rigid, hollow, parallel tubes 14, 14' defined in part by the top, bottom, and side stringers. A web member 16 separates adjacent ones of the tubes 14, 14'. As mentioned, the top 12, bottom 18, sides 11, 11' and web 16 comprise an extruded plastic. Top 12 preferably is rectangular and flat. The bottom 18 of the pallet 10 typically also is flat. Pallet 10 optionally but not necessarily is square if the desired length is set equal to the width. The two parallel, horizontal, and substantially identical hollow tubes 14, 14' form the one-piece structure of the pallet 10. The tubes 14, 14' are defined by top 12, bottom 18, and by web stringer 16 dividing the tubes. Each of the tubes 14, 14' preferably has an open end defining an entrance such that the interior hollow of the tube can be accessed from either side of the pallet 10.

As best seen in FIG. 1*a,* the entrance into each of the tubes 14, 14' defined by the bottom 18 of the pallet 10 optionally features a chamfered edge 20. Optional chamfered edge 20 aids in forklift tine entrance into the tubes 14, 14'. The entrance to a tube 14, 14' defined by the top 12 also may have a chamfered edge (not shown) to provide bilateral symmetry, such that the pallet 10 has no single functional top or bottom, but functions identically without regard for whether top 12 or bottom 18 is in contact with the floor or other supporting surface. The edges of the web 16 defining the entrance to a tube 14 or 14' may also be chamfered. Because the tubes 14, 14' are open at both ends, the pallet 10 is forklift features two-way accessibility. A "two-way" pallet thus is a pallet 10 which may be approached from either of two sides by a forklift or other lifting device.

Figure 2:
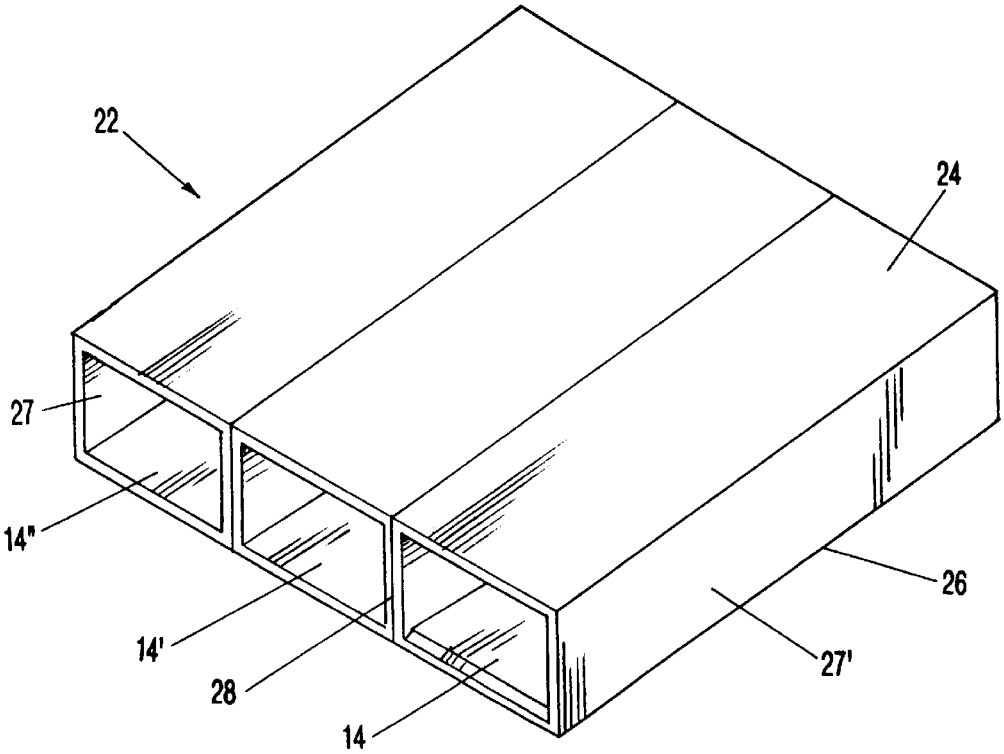
FIG. 2 is a perspective view of another preferred embodiment of the present invention, showing a three-tube, two-way pallet.

A three-tube two-way pallet 22 is shown in FIG. 2. This embodiment of pallet 22 also has a flat top 24 and flat bottom 26. The tubes 14, 14', 14" are in adjacent parallel contact, each of the tubes having a top, a bottom, and two sides. The sides of adjacent tubes 14, 14' are integrally molded or, alternatively in the instance of separately extruded tubes, are permanently adhered together in flush contact to define a web stringer or member 28. The tops of the tubes 14, 14', 14" collectively define the top 24 of the pallet 22, and the bottoms of the tubes collectively define the bottom 26 of the pallet. The two most widely spaced sides of tubes define the sides 27, 27' of the pallet 22.

Due to the additional web stringer 28, pallet 22 can carry a larger load than the pallet 10 of FIG. 1, assuming the pallet material, size and wall thicknesses are equal. Preferably but not necessarily, all the tubes 14, 14', 14' in this embodiment are of equal size. However, the tubes 14, 14', 14" should be symmetrical about the axis of the central tube 14'. This embodiment of pallet 22 has been fabricated of commingled recycled plastic and has been tested to carry 20,000 pounds static load.

Figure 3:
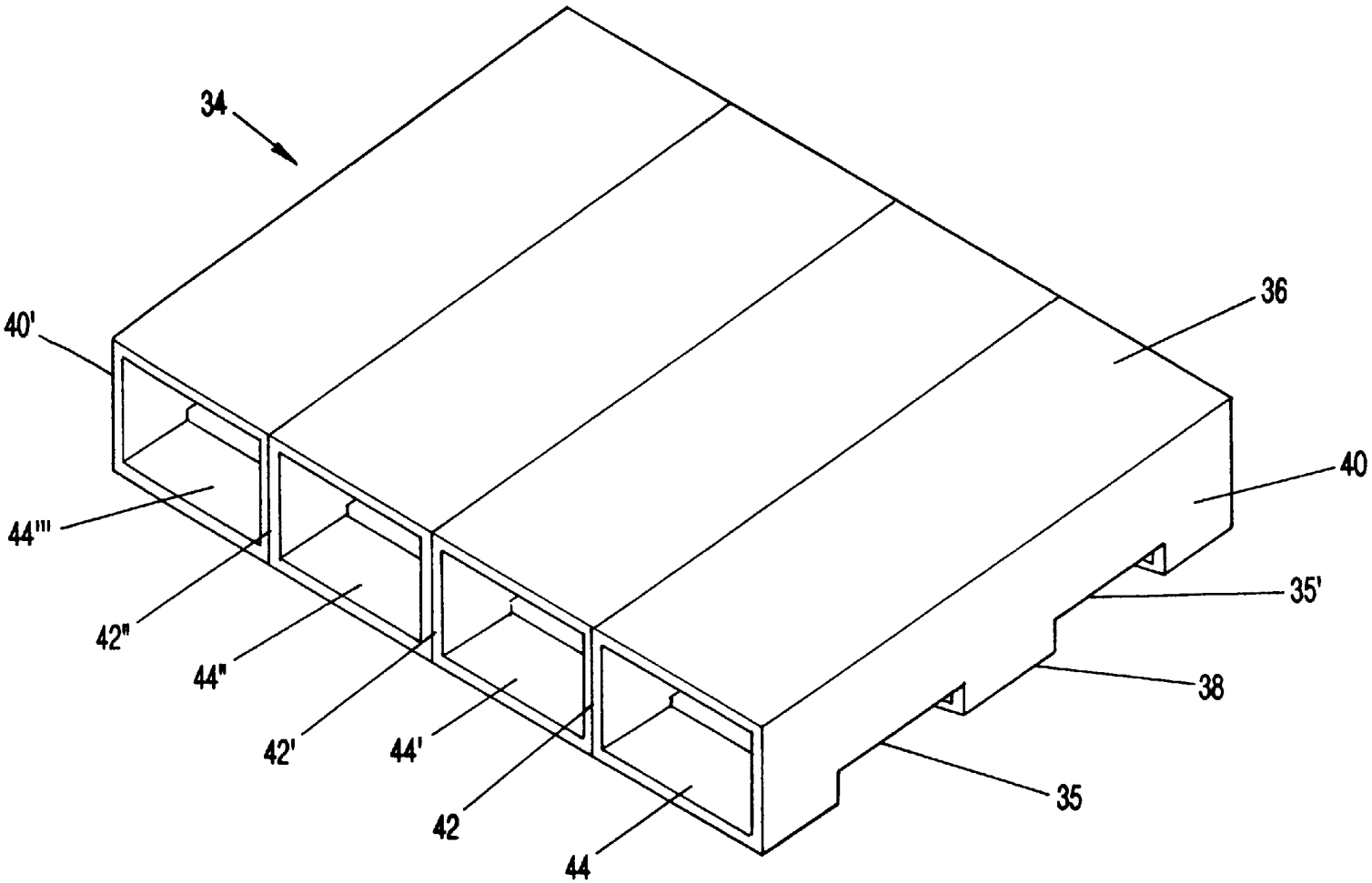
FIG. 3 is a perspective view of an alternative embodiment of the invention, showing a four-tube, four-way pallet.

Reference to FIG. 3 shows that a pallet 34 may include four tubes 44, 44', 44", 44'". Also the pallet 34 is a "four-way" pallet, which may be approached horizontally from any side to receive the tines of a fork lift or the like. In this embodiment, the pallet 34 has a notched bottom 38. As seen in FIG. 3, the pallet 34 is has a pair of channels 35, 35' or troughs molded or resected from the bottom 38 and running transversely from one side stringer 40 of the pallet to the other 40', perpendicular to the axes of the tubes 44–44'". The channels 35, 35' provide accessability to pallet moving equipment (e.g. forklift) in all four directions, as seen by the large cutouts visible on the side stringer 40 seen in FIG. 3, but also occur in the bottom 38 and all the web stringers 42, 42', 42". This embodiment has a higher load capacity than a two- or three-tube pallet if all other factors are equal. This embodiment of FIG. 3 is advantageously utilized for larger pattern pallets. When made from recycled plastic, the FIG. 3 embodiment has held up to 7,500 pounds in an edge-stacked rack without failure (FIG. 6).

Figure 4:
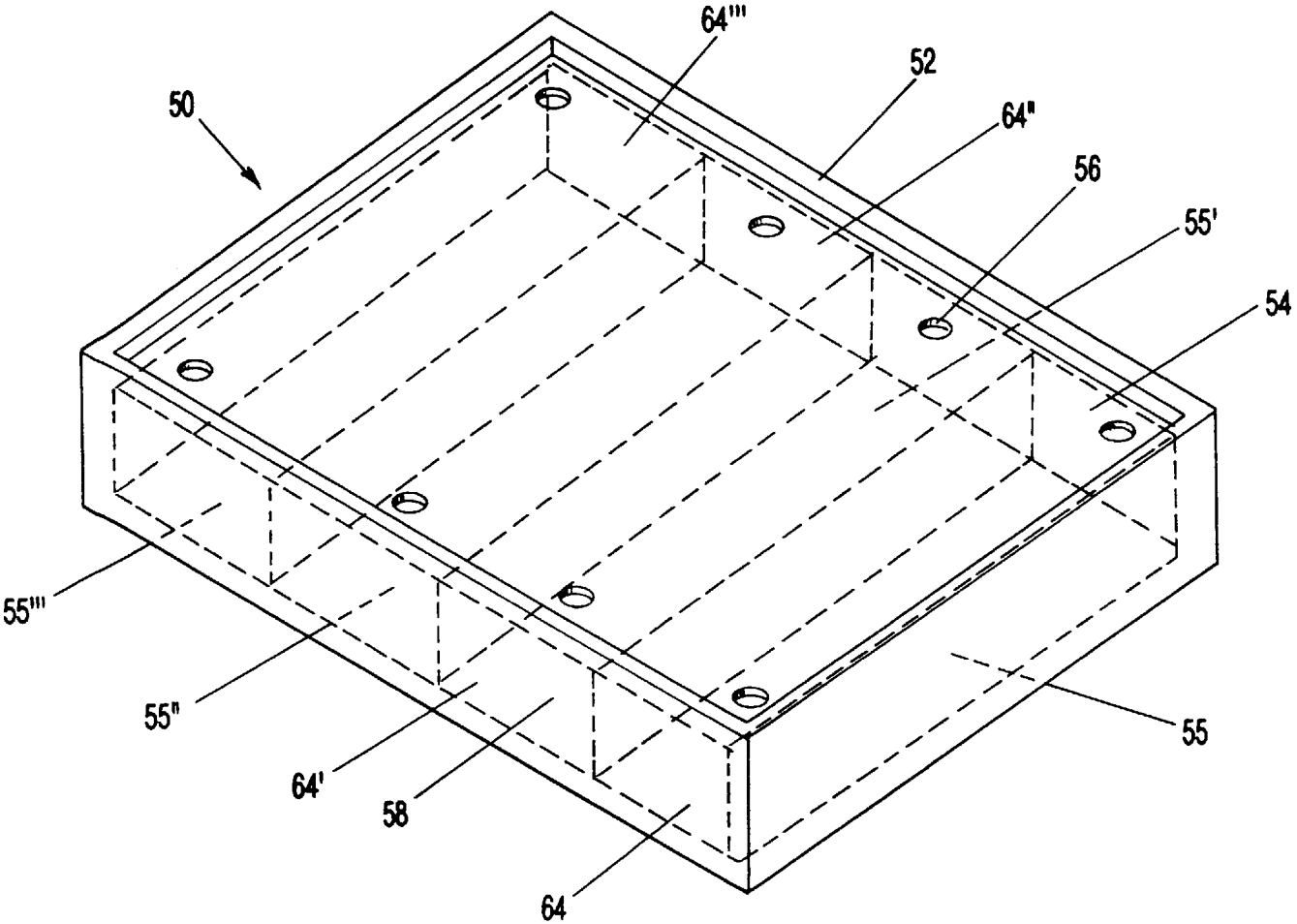
FIG. 4 is a perspective view of another alternative embodiment of the invention, illustrating a drum pallet with certain interior features depicted by phantom lines.

FIG. 4 depicts a four-tube drum pallet 50. The pallet 50 features a raised ridge 52 on and around the peripheral edge of the top 54. The ridge 52 prevents drums (not shown) from sliding off the pallet 50 during shipping. Optionally, all the end entrances to the tubes 64, 64', 64", 64'" are closed and sealed with a side panel 58 or the like as shown in the figure. With the tubes sealed closed, the tubes form secondary containment vessels 55, 55', 55", 55'". Drain holes 56 may be defined through the top 54 to allow any leaks or spills from the transported drums and confined by the ridge 52 to drain into the containment vessels 55, 55', 55", 55'". The FIG. 4 embodiment thus provides an excellent means for short and long term storage of liquid containers.

Figure 5A:
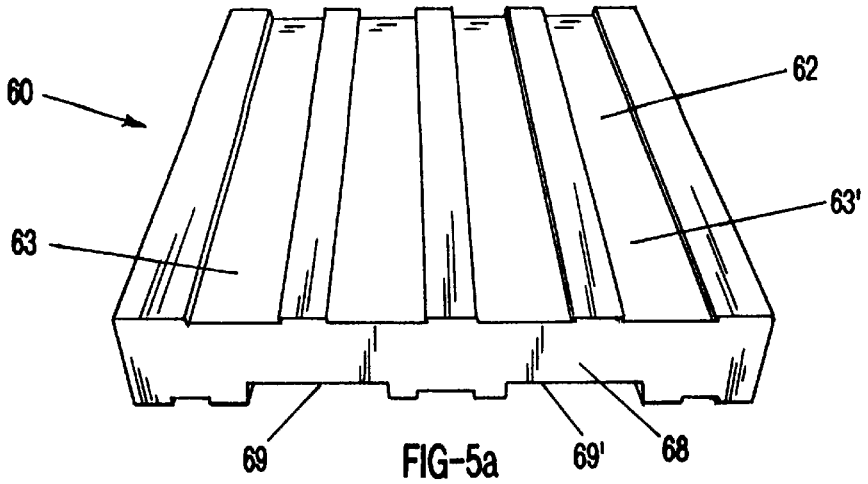
FIG. 5*a* is a perspective view of still another alternative embodiment of the invention, showing the top and side of a three-tube, four-way pallet.
Figure 5B:
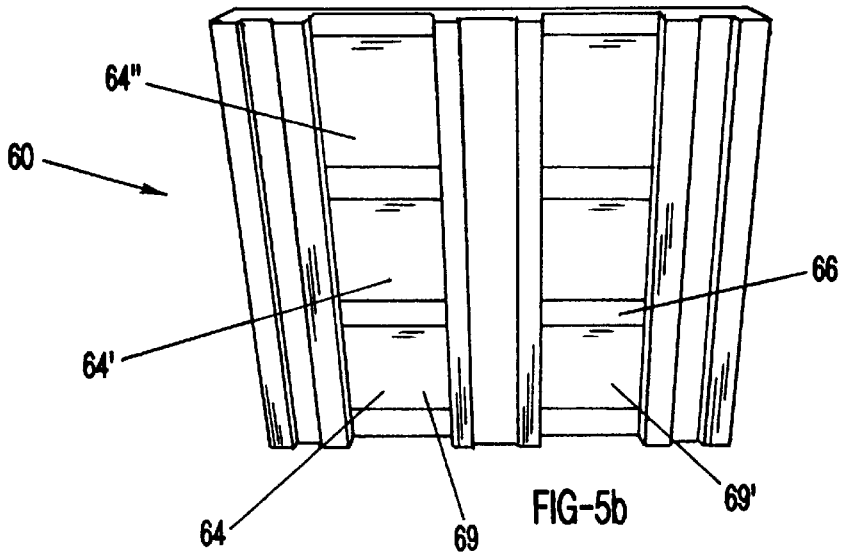
FIG. 5*b* is a perspective bottom view of the embodiment shown in FIG. *a;*
Figure 5C:
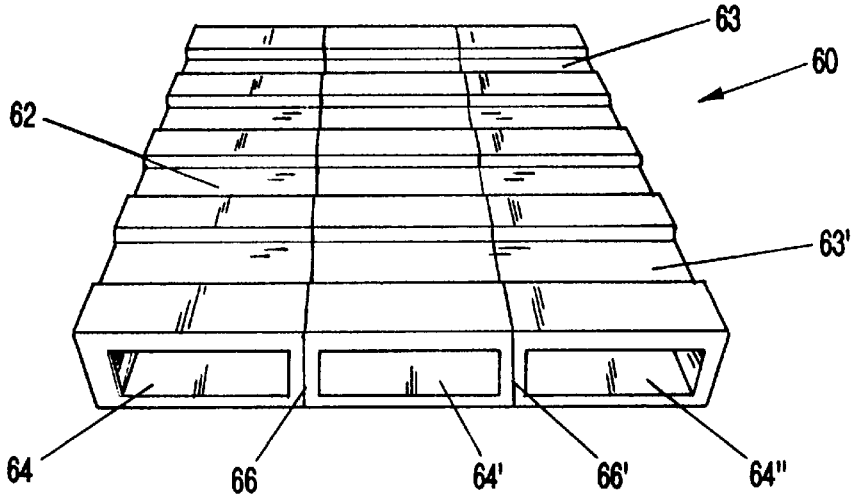
FIG. 5*c* is a perspective front end view of the embodiment shown in FIG. 5*a;*

FIGS. 5*a–c* show a three-tube four-way pallet 60 fabricated from commingled recycled plastic utilizing a certain cold extrusion process. FIG. 5*c* shows the open entrances into the horizontal tube structures 64, 64', 64" the tubes being divided by webs 66, 66'. The tubes 64 of the depicted alternative embodiment are of equal cross-sectional size; but this embodiment may be readily adapted with a variety of tube sizes and configurations, with tubes not necessarily equal in size. As seen in FIG. 5*a*, the top 62 is slotted with channels 63, 63' that do not completely penetrate the top, unlike the pallet of the FIG. 3 embodiment. Providing channels 63, 63' which do not penetrate the top 62 to intersect the hollows of the tubes 64, 64', 64" adds to the strength of the top. As seen in FIGS. 5*a* and 5*b,* the bottom 68 is similarly slotted and cut with channels 69, 69' for "four-way" lift device accessibility.

Figure 6:
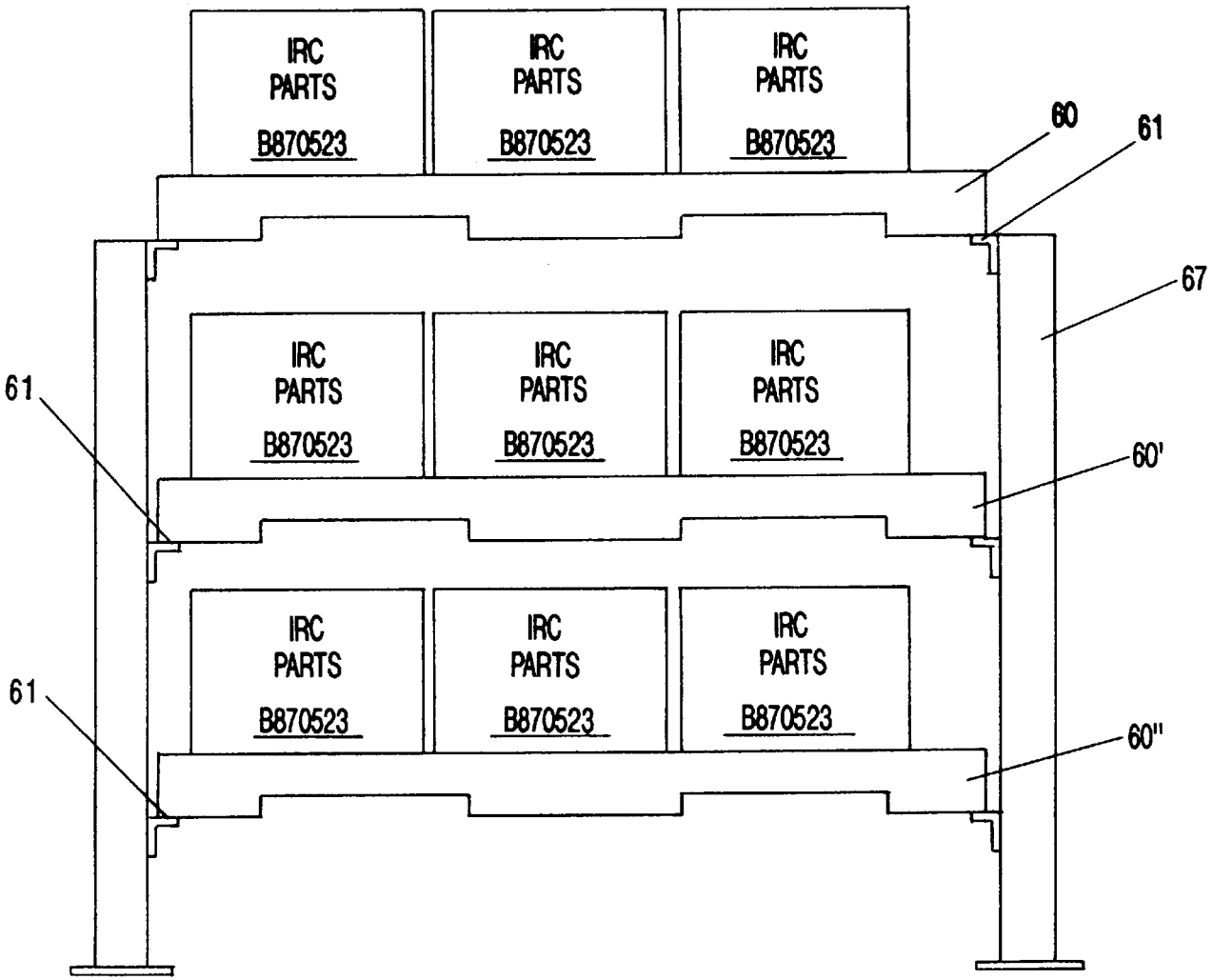
FIG. 6 is a side view of a plurality of pallets according to the present invention vertically stacked and supported by their exterior edges.

FIG. 6 illustrates that pallets 60, 60', 60" according to the invention may be stacked in a storage or transportation rack 67. Unlike pallets of conventional construction, the pallets 60, 60', 60" of the invention present durable, well defined bottom edges 61 which may be engaged with or rest upon the rails of a rack without the edges splitting, rolling, or ripping. Additionally, the tremendous load capacity of the pallets 60, 60', 60" permits them to span the rail-to-rail rack distance with little bowing or sagging, and with little risk of failure, even when loaded as shown in FIG. 6.

Figure 7:
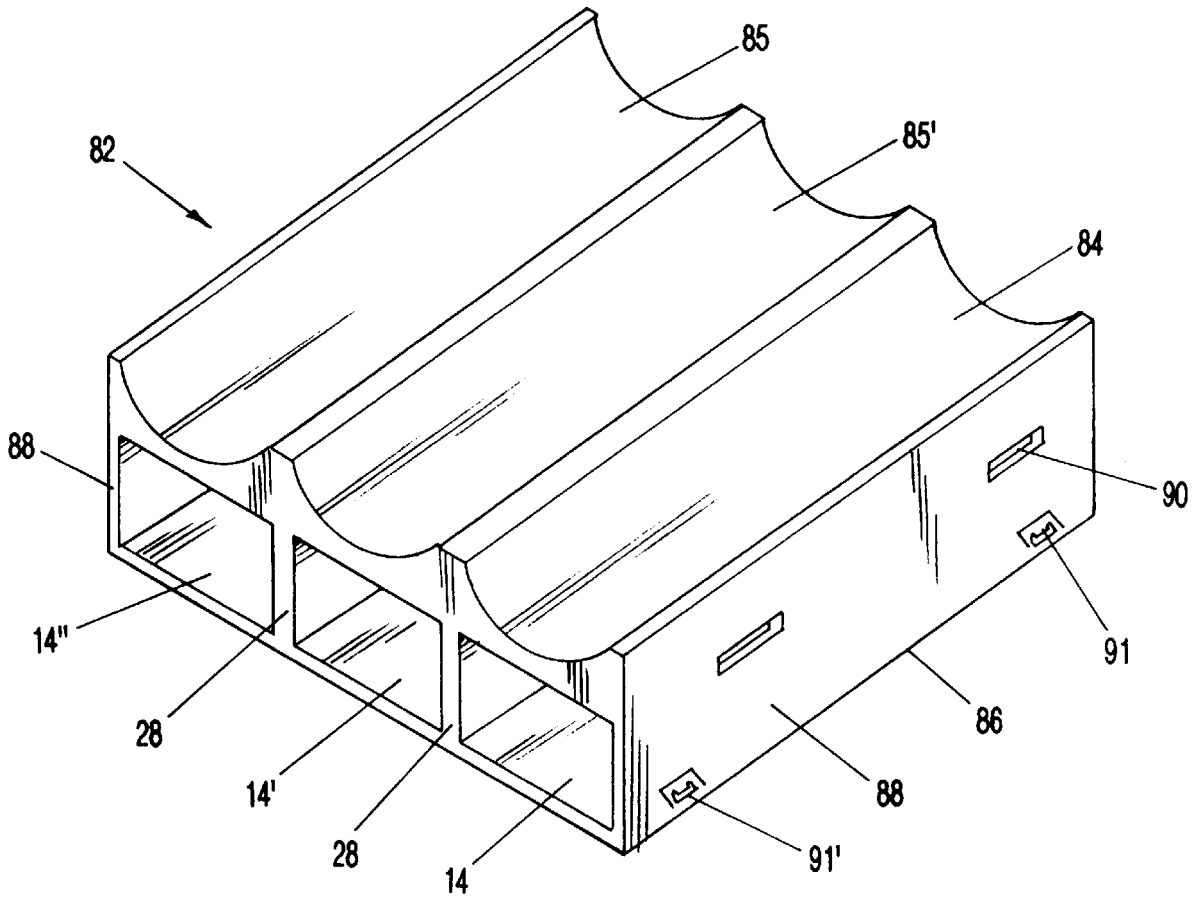
FIG. 7 is a perspective view of still another alternative embodiment of the invention, showing a three-tube custom pallet.

Referring to FIG. 7, there is provided a three-tube, two-way custom pallet 82. Custom pallet 82 is extruded or pultruded to define a top 84 which is custom-shaped to receive any of a variety of particular containers or items. The illustrated embodiment, for example, has custom top 84 which is shaped to define arcuate beds 85 , 85' for receiving spools, cylindrical tanks, or other cylinder-shaped objects. The bottom 86 is flat and the each of the sides 88 defines cutouts 90, 90' to receive hold-down attachments (not shown) such as straps or the like. Alternatively, or additionally, any of a variety of separately manufactured fasteners 91, 91', such as rigid cleats, pivotal D-rings in bezels, buckles, or the like may be embedded into the pallet 82 at or immediately after molding or extrusion, thereby to permanently and reliably fix such fasteners to the pallet for use in tie-down situations and the like. An advantage of the invention is, therefore, that the pallet 82 can be custom-shaped to receive particularized goods, and provided with selected specialized fasteners 91, 91', for storage and transport in a safe and secure manner.

Figure 8:
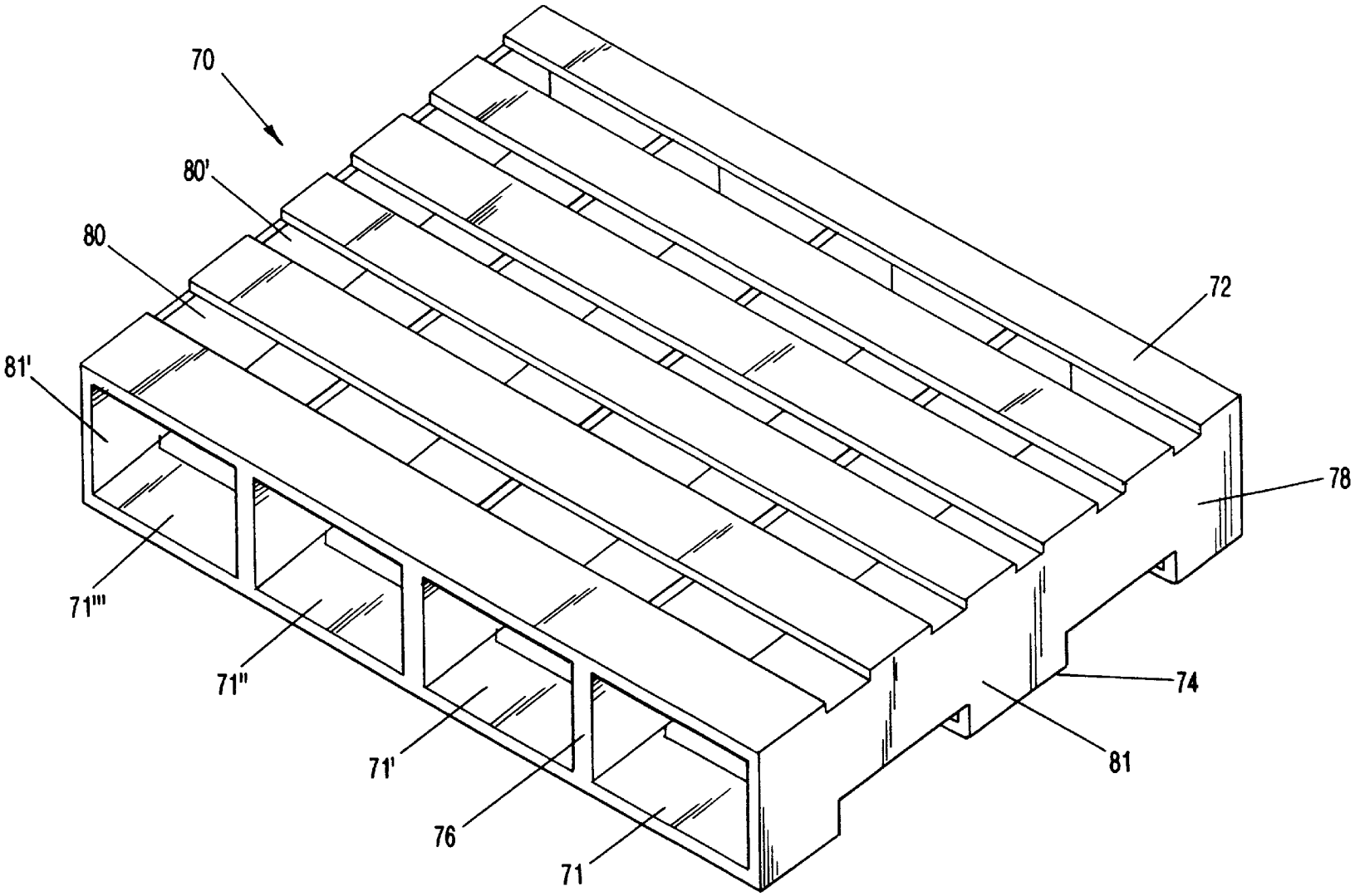
FIG. 8 is a perspective view of another alternative embodiment of the invention, showing a four-tube, four-way pallet.

FIG. 8 shows a four-tube, one-piece, four-way pallet 70. This alternative embodiment of the invention presents the advantage of light weight. The top 72 of the pallet 70 is completely penetrated by a plurality of parallel notches 80, 80'. The notches 80, 80' intersect with the hollows of the tubes 71, 71', 71", 71'", so that the top 72 effectively comprises a plurality of parallel slats extending between the side stringers 81, 81' and integrated with the tops of each web 76. The reduced amount of material comprising the top 72 results in a lighter weight pallet. The bottom 74 may be solid, or preferably is resected with a pair of channels as shown and similarly to FIG. 3 to provide for four-way approachability with a fork lift.

The pallets of the present invention, due to their configuration and durability, are ideal for multi-trip applications. For a small initial investment, a pallet is provided which may be used repeatedly, rather than discarded after one or two shipping trips. Additionally, any of the embodiments depicted may have magnetic strips, or passive or active electronic identification devices, embedded into the pallet material for ease of tracking. The durable, re-usable character of the apparatus of the invention justifies the added benefit of built-in electronic tracking devices and/or other indicia, such as surface mounted bar code or other reader codes. Hold-down strap and fixture holes can be added, as well as latches and fasteners embedded in the material. A crate may be attached or added to the top of this pallet for a fruit pickers skid or parts container.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A pallet apparatus comprising at least two open-ended rectangular tubes in adjacent parallel contact, each said tube comprising a top, a bottom, and two sides, the sides of adjacent said tubes permanently adhered together in flush contact, and said tops of said at least two tubes collectively defining the top of said pallet and said top of said pallet having a periphery with a ridge on said periphery, said bottoms of said at least two tubes collectively defining the single flat bottom of said pallet, and the two most widely spaced ones of said sides defining the sides of said pallet, and further comprising panel means for closing the open ends of said tubes, and at least one drain hole penetrating said top of said pallet and in communication with one of said tubes.

2. An apparatus according to claim 1 wherein said tubes comprise tubes integrally extruded from plastic.

* * * * *